United States Patent [19]

Calder

[11] Patent Number: 4,736,892

[45] Date of Patent: Apr. 12, 1988

[54] SELF-ALIGNING SPRAY TIP

[75] Inventor: Oliver J. Calder, Orange, Calif.

[73] Assignee: Phyllis Graham, Orange, Calif.

[21] Appl. No.: 926,196

[22] Filed: Nov. 3, 1986

[51] Int. Cl.[4] ..... B05B 1/04

[52] U.S. Cl. ..... 239/592; 239/594; 239/595; 239/599; 239/600

[58] Field of Search ..... 239/589, 593, 594, 595, 239/596, 597, 599, 600, 601, 592, 602

[56] References Cited

U.S. PATENT DOCUMENTS

| | | | |
|---|---|---|---|
| 1,276,245 | 8/1918 | Millard et al. | 239/596 |
| 3,447,756 | 9/1966 | Lawrence | 239/594 |
| 3,754,710 | 8/1973 | Chimura | 239/597 |

FOREIGN PATENT DOCUMENTS

| | | | |
|---|---|---|---|
| 717464 | 10/1954 | United Kingdom | 239/592 |

OTHER PUBLICATIONS

Airless Spray Tips, DJ Type I brochure, Cornerstone Product Development Co., Providence, R.I.

*Primary Examiner*—Andres Kashnikow
*Assistant Examiner*—Karen B. Merritt
*Attorney, Agent, or Firm*—Plante, Strauss & Vanderburgh

[57] ABSTRACT

There is disclosed an orifice tip which has a cylindrical base with an asymmetric head, preferably in the shape of a single upstanding elongated rib which is centrally located on the cylindrical base. The rib has tapered side walls with an arcuate, convex edge that has a transverse V-groove. The V-groove intersects a central passageway through the orifice tip, thereby providing a spray eyelet which is precisely oriented to the V-groove. The orifice tip is mounted in a holder having a transverse bore that terminates in an asymmetric receptacle in the form of an elongated slot which receives the elongated rib of the orifice tip, thereby precisely orienting the orifice tip in the holder. The orifice tip is particularly advantageous as it can be assembled to its holder with automated equipment.

14 Claims, 2 Drawing Sheets

SELF-ALIGNING SPRAY TIP

BACKGROUND OF THE INVENTION

1. Field of Invention

This invention relates to a spray tip orifice and, in particular, to a spray tip orifice for use with airless liquid spraying.

2. Brief Description of the Prior Art

Airless liquid spraying, in which the liquid to be sprayed is placed under a high pressure and discharged through very hard orifice tips, which are formed of tungsten carbide, is widely accepted by professional painters. The spray tip orifices which are used are formed of sintered tungsten carbide powders using heat and pressure to compact the powders into a very hard and attrition resistant bodies. Commonly, the tungsten carbide tips are formed with a cylindrical base and a hemispherical dome centrally located on the face of the base. A central passageway is provided in the tungsten carbide tip which intersects a V-groove on its discharge face, providing an elongated eyelet at the discharge face of the nozzle. This eyelet imparts a fan shape to the spray discharged from the nozzle.

Since the V-groove imparts a directional pattern to the spray, it is necessary to align the orifice spray tip precisely in its holder so that the spray pattern will have the desired orientation to the spray gun. Heretofore, the orientation of the tungsten carbide spray tip orifice in holders has been a tedious step, requiring relatively experienced and skilled personnel.

BRIEF DESCRIPTION OF THE INVENTION

This invention is a spray tip orifice for airless liquid spraying which is formed of sintered, tungsten carbide powders or similarly hard refractory materials. The spray tip orifice has a cylindrical base with an asymmetric head, which cooperates with a mating, asymmetric receptacle in the orifice tip holder. Preferably the asymmetric head comprises an elongated raised rib on the base of the orifice tip. This rib has a greater length than width and is symmetrically positioned on the cylindrical base to provide circular segment shoulders at its opposite sides. Preferably, the sidewalls of the upstanding rib are inclined and, most preferably, the top edge of the rib is smoothly rounded with a convex arcuate surface. The spray tip orifice has a centrally located through passageway which is intersected by a V-shaped groove which is centrally located on the rib and which extends across the width of the upstanding rib. Also preferably, the rib has a length equal to the diameter of the cylindrical base and its end walls are thus vertical projections of the side wall of the cylindrical base.

The spray tip orifice of the invention is used in combination with a spray tip holder which has a holder body having a bore extending into, but not entirely through, the holder body. This bore is intersected by an elongated slot having substantially the same width as the width of the upstanding rib of the orifice tip member and having a length which is at least equal to the length of the upstanding rib. At the intersection of the slot and bore of the holder body, there are shoulders at opposite sides which form abutment stops for the cooperative shoulders of the orifice tip member, whereby the orifice tip member can be restrained in the holder body.

The invention provides for very rapid and simple installation and mounting of the orifice tip member in the holder body. As the head of the orifice tip member is asymmetric, it readily indexes with the similarly shaped, asymmetric slot of the holder body. The spray tip orifice can be quickly aligned and seated in the holder body by proper orientation of its asymmetric head with the asymmetric receptacle in the holder body. The tapered head provides some tolerance in this alignment, as any minor misalignment is corrected as the tip is advanced in the receptacle. Thereafter, the orifice tip member is secured in the holder body with suitable means, e.g., cement, packing material or a threaded or press-fitted sleeve. Since the V-shaped groove is precisely orthogonal to the length, or major axis, of the upstanding rib, and since the elongated slot is also precisely oriented on the holder body, a very precise alignment of the orifice tip member is achieved, without requiring any high degree of skill or experience of the assembly personnel. The orifice tip member is particularly advantageous in that it also can be placed and precisely oriented in a holder with automated assembly equipment.

BRIEF DESCRIPTION OF THE DRAWINGS

The invention will be described with reference to the figures of which.

DESCRIPTION OF THE PREFERRED EMBODIMENT

Figure 1:
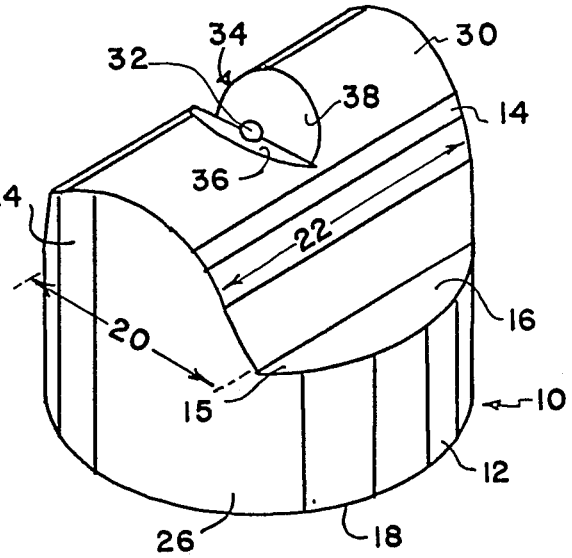
FIG. 1 is a perspective view of the orifice tip of the invention.

Referring now to FIG. 1, the orifice tip member 10 is shown with a cylindrical base 12 and an asymmetric head, which is formed by a single, upstanding rib 14 on its upper face 16. The face 16 is substantially parallel to the reverse face 18 of the cylindrical base 12.

The rib 14 has a lesser width 20 than its length 22, thereby forming an elongated rib which is centrally positioned on the cylindrical base 12. Rib 14 is an integral, upstanding extension of the cylindrical base 12 and is centrally located to provide shoulders such as 15 on its opposite sides which are equally shaped circular segments. Preferably, the end walls such as 24 of the upstanding rib 14 are integral extensions of the side wall 26 of the cylindrical base 12 and the length 22 is thus equal to the diameter of the cylindrical base 12. The upstanding rib 14 has a convex arcuate upper edge 30 which has a small radius of curvature. Typically the diameter of the base is from $\frac{1}{8}$ to about $\frac{1}{4}$ inch, preferably from 5/32 to about 3/16 inch.

The orifice tip member 10 has a central or coaxial through passageway 32 which is intersected by a V-shaped groove 34 which is orthogonal to the length or major axis of the upstanding rib. Preferably, the rib has chamfered side walls 36 and 38 to provide an included angle therebetween which is from 20 to about 45 degrees, preferably about 30 degrees.

The spray tip orifice is formed of suitably hard refractory material such as ceramics and sintered metal carbide powders. Most preferably, the spray tip orifice is formed of tungsten carbide powders which are compacted and sintered under heat and pressure, in conventional manufacturing techniques.

The spray tip orifice of the invention is used with a spray tip holder which is adapted for use in the particular spray tip. Spray tip holders of various shapes have been used with spray tips of widely varied shapes. The spray tip holders which have been used include elongated flat plates and various bodies having surfaces of revolution such as spheres, cylinders, etc. Those bodies having surfaces of revolution are commonly used with rotatably reversible spray tips whereby the holder can be rotated 180 degrees to reverse the spray tip in the assembly thereby providing for use of the liquid to forcefully eject any debris or foreign matter that may clog the central passage of the spray tip orifice during use.

Figure 2:
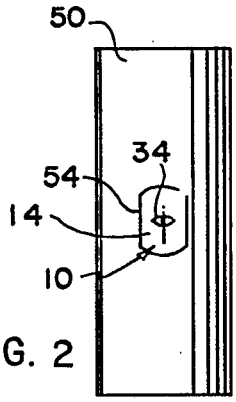
FIG. 2 is a front view of a suitable, cylindrical holder member.
Figure 3:
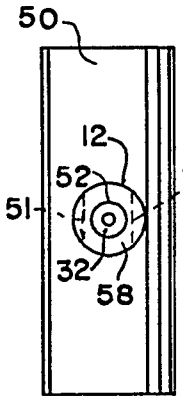
FIG. 3 is a rear view of the cylindrical holder of FIG. 4.
Figure 4:
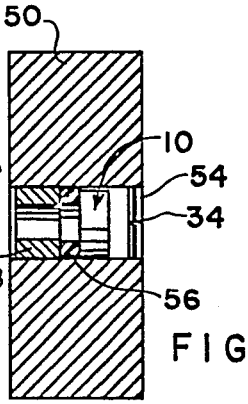
FIG. 4 is a sectional view of the holder, showing the orifice tip in place.

A suitable and preferred orifice tip holder body is depicted in FIGS. 2 through 4. As there illustrated, the orifice tip holder body 50 is a cylindrical body having a transverse bore 52 which is orthogonal to its major axis. In accordance with this invention, the bore 52 does not extend entirely through body 50 and intersects an elongated slot 54, which forms a receptacle to receive the asymmetric head of the orifice tip 10. The slot 54 has a width which is at least equal to, but not substantially greater than, the width of the upstanding rib 14 of the orifice tip member 10, which is shown seated in the slot 54. Additionally, the length of the elongated slot 54 is at least equal to and not substantially greater than the length of the upstanding rib 14 of the orifice tip member 10 thereby indexing the orifice member 10 in a very precise manner within the bore 52 and slot 54. As can be seen from this illustration, the V-shaped groove 34 or orifice tip 20 is thereby precisely oriented orthogonal to the major axis of the cylindrical member 50, this ensuring that the fan shaped spray discharged from the orifice tip member will spread outwardly in a pattern with its major axis also orthogonal to the major axis of the spray tip body.

Referring now to FIG. 3, the inlet face of bore 52 is partially closed by sealing sleeve 58 which has a central opening communicating with the through bore 32 of the orifice tip 10. The central through passageway 32 is thus symmetrically oriented in the bore 52 of cylindrical body 50. Once installed in this position, the orifice tip member 10 is retained therein with suitable packing material, all as illustrated in the sectional view of FIG. 4.

Referring now to FIG. 4, there is depicted an elevational sectional view of the spray tip holder 50 and sealing sleeve 58. The orifice member 10 of the invention is shown as it is seated in slot 54. As there illustrated, the cylindrical passage 52 extends into but not entirely through the body 10 and is intersected by the narrow elongated slot 54. Slot 54 receives the upstanding rib 14 of the orifice tip member. The shoulders such as 15 of the orifice tip member are received against opposing abutments or shoulders (shown as 51 and 53 by phantom lines in FIG. 3) of the cylindrical body 50 which are formed at the intersection of the cylindrical central passage 52 and the elongated slot 54. The orifice tip member is retained in the assembly by a suitable packing material or by permanent adhesives, all as conventionally used to seat orifice tip members in conventional holders. A preferred sealing means is shown in FIG. 4 as a plastic seal washer 56 with a metal sleeve 58 which is press fitted in bore 52.

Figure 5:
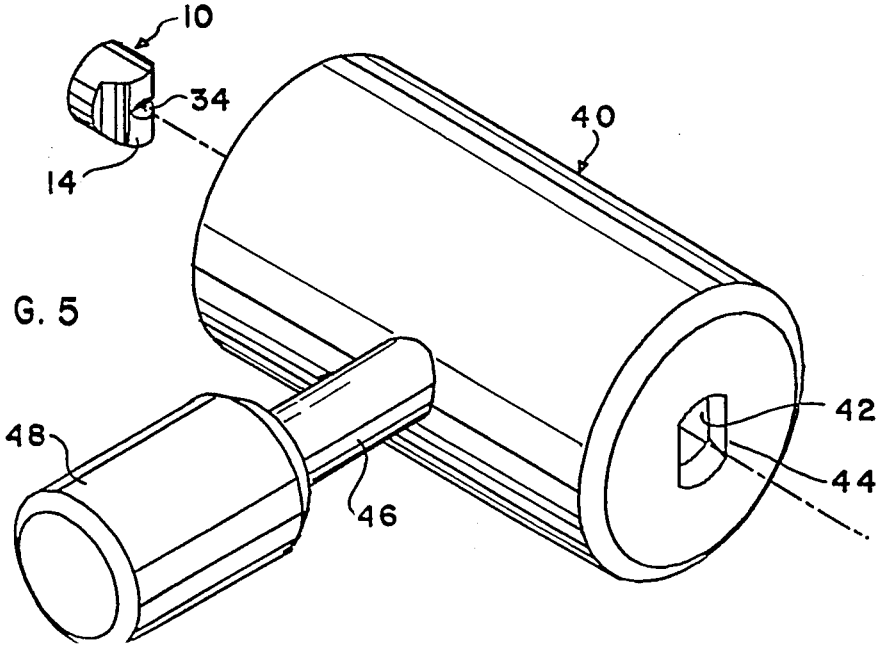
FIG. 5 is an exploded perspective view of a suitable holder with the orifice tip.

FIG. 5 illustrates a holder which is substantially of the configuration described in my prior U.S. Pat. No. 3,831,862. This holder 40 is a cylindrical body with a longitudinal bore 42, which intersects slot 44. The slot 44 is of the same shape and size as slot 54, previously described, and receives the rib 14 of orifice tip 10 in the same manner as previously described. Preferably, the side walls of the slot 44 are chamfered at an angle so that these walls diverge outwardly towards the inside of the holder, thereby conforming to the inclined sidewalls of the rib 14 of the orifice tip. The holder has a pin 46 with a handle 48 which are preferably attached at the middle of the cylindrical body of the holder 40. This pin cooperates with an L-shaped slot in a cylindrical spray tip housing, thus forming a bolt action lock which secures the position of the holder 40 in the spray tip housing. The slot 44 is precisely aligned to the pin 46, preferably orthogonal thereto, thereby providing a precise indexing of the orifice eyelet (V-groove 34) in the spray tip housing. As with the holder shown in FIGS. 2–4, the orifice tip 10 can be sealed in the assembly by seal washer 56 and sealing sleeve 58, shown in FIG. 4.

Figure 6:
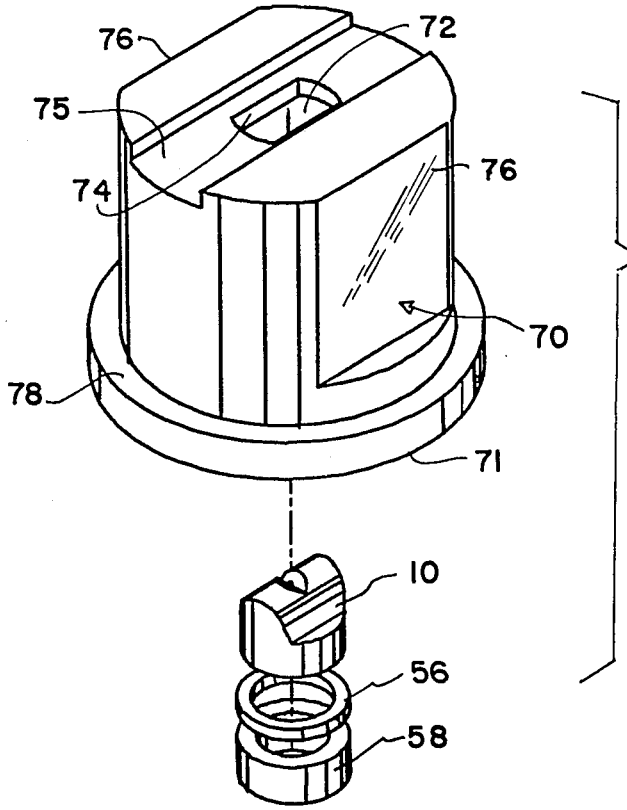
FIG. 6 is an exploded perspective view of the orifice tip of the invention with another holder used in a spray tip and FIG. 7 is an exploded perspective view of the orifice tip of the invention with a holder and handle as used in a spray tip.

FIG. 6 illustrates an alternative orifice tip holder 70. This tip holder is a conventional holder which has been used for alignment of other orifice tips, and which is modified to be used with the orifice tip 10 of this invention. The holder is in the form of a cylindrical cap with a central longitudinal bore 72 that receives the orifice tip member 10, seal washer 56 and metal sleeve 58. The holder 70 has a pair of alignment flats 74 and 76 which engage indexing flats in a spray gun housing (not shown), whereby the orifice tip member 10 is precisely aligned in the spray gun. A central groove 75 is provided across the face of the holder 70. The holder also has a peripheral external lip 78 about its base 71 for retention in a through passageway of a spray gun. A central bore (not shown) extends from the undersurface 71 of the holder. The holder is adapted for use with the orifice tip of this invention by an elongated slot 74 in central groove 75, which opens to the central bore 72. Slot 74 is similar in shape and dimensions to slot 54 of holder 50. The indexing flats 76 on the holder, the elongated slot 74, and the elongated rib 14 of the orifice tip 10 all coact to precisely align the slot 34 of the orifice tip precisely in a spray housing.

Figure 7:
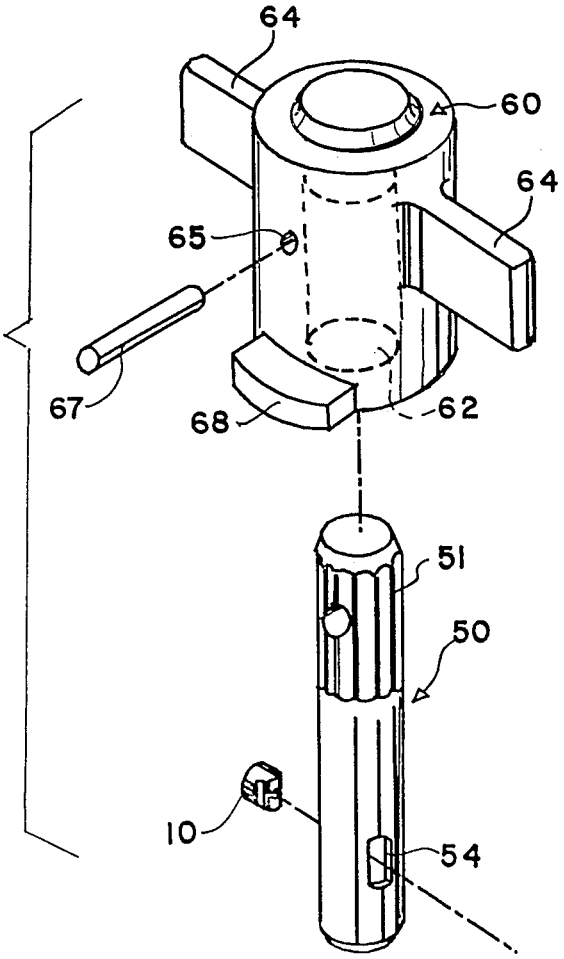

FIG. 7 illustrates an orifice tip holder body 50 which is substantially identical to that shown in FIGS. 2–4. Holder body 50 has a transverse through bore which terminates in the aforementioned elongated slot 54 to receive the orifice tip member 10 in alignment with its slot 34 transverse to the longitudinal axis of body 50 (all as shown in FIGS. 4–6). A seal washer and metal sleeve such as elements 56 and 58 (shown in FIG. 4) can be used to seal the tip 10 in holder 50. A hand knob 60 which has a central bore 62 receives the upper end 51 of the holder body 50. The hand knob 60 mounts the holder body 50 in a receiving bore of a spray tip housing which permits rotation of the holder body to reverse the position of the orifice tip member between spraying and cleaning positions. The spray tip housing and its associated spray guard is disclosed and claimed in my copending application Ser. No. 766,190, filed Aug 16, 1985. The hand knob has a pair of diametric and opposite wings 64 and 66 and has a radial prong 68 at its bottom edge. The prong has a predetermined alignment to a slot in a spray guard which is mounted on the spray tip housing and aligns the orifice tip 10 to either of two predetermined positions in the spray tip housing, thereby precisely orienting the orifice tip member in either its spraying, or cleaning, position.

The invention thus provides very facile indexing of the orifice tip member to the holder body without requiring any specialized skill or training of the assembly personnel. It is particularly suited to automated assembly equipment which can insert, align and seal the orifice tips in holders, a procedure which currently is only performed manually. The elongated upstanding rib of the body readily orients the orifice tip body to the holder body, and its tapered side walls provide a tolerance in the precision of alignment when the orifice tip is inserted into the holder. Minor errors in precise alignment are corrected, as the tapered side walls of the elongated rib of the orifice tip wall rotate the orifice tip slightly to adjust the tip precisely to the elongated slot of the holder body as it is seated in its mating receptacle in the holder.

Since only the head of the orifice tip is asymmetric, the indexing function does not compromise the sealing of the orifice tip in the holder. The orifice tip retains a cylindrical base which can be readily sealed in a receiving cylindrical bore of the holder body without any specialized packing or retention material. The cylindrical base of the orifice tip provides maximum sealing area for the sealing washer or packing material, an important factor in high pressure airless liquid spraying.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims.

What is claimed is:

1. The combination of:

a. a spray tip holder having a cylindrical bore extending from one side thereof into, but not entirely through, said holder and terminating in an asymmetric receptacle having receiving shoulders, and b. a spray tip orifice having a cylindrical base and an asymmetric head with at least one external shoulder therebetween, and with a central through passageway terminating in a V-groove in said head to provide a spray eyelet, and mounted in said cylindrical bore of said holder with said asymmetric head received in said asymmetric receptacle of said holder with said external shoulder received against said internal shoulder of said receptacle whereby said eyelet is oriented precisely in said holder; and c. sealing means received against the circular face of said cylindrical base to seal said spray tip orifice in said spray tip holder.

2. The combination of claim 1 wherein said asymmetric head is a central, upstanding rib on said cylindrical base to provide external sector shoulders therebetween.

3. The combination of claim 2 wherein said asymmetric receptacle is an elongated slot in said holder which intersects said cylindrical bore thereof, and which has a length equal to the diameter of the cylindrical bore and a width less than the diameter of the cylindrical bore to provide an internal sector shoulders therebetween.

4. The combination of claim 1 wherein said spray tip holder is a cylindrical body with said cylindrical bore extending transversely therein.

5. The combination of claim 4 including a hand knob having a central bore that receives one end of said cylindrical body with opposite radial wings extending therefrom.

6. The combination of claim 5 including a radial prong projection from the base of said hand knob to serve as an indexing key for precise orientation of said holder in a spray nozzle.

7. The combination of claim 6 in which said radial prong is oriented at 90 degrees to said cylindrical bore.

8. The combination of claim 1 wherein said holder is a cylindrical cap having at least one external flat on one end thereof and having a longitudinal cylindrical bore extending from one end and terminating in said elongated slot on the other end thereof.

9. The combination of claim 8 wherein said cylindrical cap has an external peripheral lip about said one end.

10. A spray tip for airless liquid spraying which comprises:

(a) a cylindrical base with a flat face and (b) a single, central located, upstanding rib having a top edge, a length greater than its width centrally located on said cylindrical base with opposite sector shoulders therebetween and with the side walls of said rib chamfered outwardly from the top edge of said rib to said sector shoulders;

(c) a central passageway extending from said flat face and terminating in said rib; and (d) a V-shaped groove centrally traversing the end face of said rib and intersecting said central passageway to provide a spray eyelet which is oriented orthogonally to said sector shoulders.

11. The spray tip orifice of claim 10 wherein said side walls are chamfered at an included angle from 20 to 45 degrees.

12. The spray tip orifice of claim 11 wherein said side walls are chamfered at an included angle of about 30 degrees.

13. The spray tip orifice of claim 10 wherein the upper edge of said rib is convexly arcuate.

14. The spray tip orifice of claim 10 wherein said rib has a length equal to the diameter of said base and its end walls are straight projections of the cylindrical sidewall of said base.

* * * * *